US006738995B1

(12) United States Patent
Payne et al.

(10) Patent No.: US 6,738,995 B1
(45) Date of Patent: May 25, 2004

(54) BUCKET FILLER

(76) Inventors: Reginal Eugene Payne, 7104 Gamma La., Fredericksburg, VA (US) 22407; Michelle Neal Payne, 7104 Gamma La., Fredericksburg, VA (US) 22407

( * ) Notice: Subject to any disclaimer, the term of this patent is extended or adjusted under 35 U.S.C. 154(b) by 24 days.

(21) Appl. No.: 10/183,340

(22) Filed: Jun. 28, 2002

Related U.S. Application Data

(60) Provisional application No. 60/339,456, filed on Dec. 14, 2001.

(51) Int. Cl.[7] ..... A47K 1/00; E03C 1/00

(52) U.S. Cl. ..... 4/661

(58) Field of Search ..... 4/567, 568, 615, 4/661, 569, 570, 616, 617, 619; 239/548, 588

(56) References Cited

U.S. PATENT DOCUMENTS

| | | | | | |
|---|---|---|---|---|---|
| 1,641,778 | A | * | 9/1927 | Overton | 4/615 |
| 3,131,868 | A | * | 5/1964 | Coleman | 239/588 |
| 4,413,362 | A | * | 11/1983 | Chianco et al. | 4/567 |
| 4,447,917 | A | * | 5/1984 | Walter | 239/548 |
| 4,784,184 | A | | 11/1988 | Gates | |
| 5,070,552 | A | * | 12/1991 | Gentry et al. | 4/615 |
| 5,598,867 | A | * | 2/1997 | Sullivan | 137/357 |
| 5,682,620 | A | | 11/1997 | Stoltz et al. | |
| 5,758,690 | A | | 6/1998 | Humpert et al. | |
| 6,098,212 | A | | 8/2000 | Rogan | |
| 6,315,220 | B1 | * | 11/2001 | Grubb | 4/615 |
| 6,345,397 | B1 | | 2/2002 | Haubrich | |
| D454,942 | S | | 3/2002 | Selby | |
| 6,427,259 | B1 | * | 8/2002 | Cawthon | 4/619 |
| 6,431,217 | B2 | * | 8/2002 | Robinson | 138/110 |

* cited by examiner

*Primary Examiner*—Tuan N. Nguyen
(74) *Attorney, Agent, or Firm*—Stephen Christopher Swift; Swift Law Office

(57) ABSTRACT

An apparatus for filling buckets, pails or other containers with water or other fluid from faucets, and a method of filling containers with fluid using the apparatus. The apparatus comprises an attachment unit or funnel that is placed over a faucet, a hose, and a tip at the opposite end of the hose with a hook to retain the bottom end of the hose in the bucket. The attachment unit is generally cylindrical and made of a solid foam that has a closed cellular structure. The attachment unit can be screwed on and off the upper end of the hose. In a first preferred embodiment the attachment unit is configured for standard faucets, with an opening in the center of its top and a vertical channel. In a second preferred embodiment the attachment unit is configured for contemporary faucets, with an opening in its side and a curved channel.

14 Claims, 6 Drawing Sheets

BUCKET FILLER

CROSS REFERENCE TO RELATED APPLICATION

This application is based on Provisional Patent Application Serial No. 60/339,456, filed Dec. 14, 2001.

BACKGROUND OF THE INVENTION

1. Field of the Invention

The present invention relates to devices for conveying water from a faucet to a container.

2. Description of the Prior Art

There have been previous inventions that can convey water from a faucet, but none in the prior art are equivalent to the instant invention.

U.S. Pat. No. 4,784,184, issued on Nov. 15, 1988, to Christopher G. Gates, discloses an elastic drip silencer and funnel. The funnel is elastic and fits around and under the faucet. The instant invention is distinguishable, in that it has an expandable foam portion that fits around the faucet.

U.S. Pat. No. 5,682,620, issued on Nov. 4, 1997, to David L. Stoltz and Max E. Murphy, discloses a drain cable apparatus, including a hose that may be coupled to a faucet. Again, the instant invention is distinguishable, in that it has an expandable foam portion that fits around the faucet.

U.S. Pat. No. 5,758,690, issued on Jun. 2, 1998, to Jurgen Humpert, Eckhard Gransow and Bernd Bischoff, discloses a hose-type pull-out faucet, in which a spout is connected to a base by a hose that can be pulled out. The instant invention is distinguishable, in that it is designed to be attached to the end of a faucet's spout, rather than between the spout and a base.

U.S. Pat. No. 6,098,212, issued on Aug. 8, 2000, to James M. Rogan, discloses a plumbing apparatus for aiding in the snaking of drain pipes, with a flushing water tube connected to a flexible hose that can be attached to a faucet. It does not disclose an expandable foam portion that can fit around the faucet, as in the instant invention.

U.S. Pat. No. 6,345,397, issued on Feb. 12, 2002, to Mark A. Haubrich, discloses an outdoor faucet attachment, which is an S-shaped tube, without an expandable foam portion as in the instant invention.

U.S. Pat. No. Des. 454,942, issued on Mar. 26, 2002, to William J. Selby, discloses a design for a safety hose.

None of the above inventions and patents, taken either singly or in combination, is seen to describe the instant invention as claimed.

SUMMARY OF THE INVENTION

The present invention is an apparatus for filling buckets, pails or other containers with water or other fluid from faucets, and a method of filling containers with fluid using the apparatus. The apparatus comprises an attachment unit or funnel that is placed over a faucet, a hose, and a tip at the opposite end of the hose with a hook to retain the bottom end of the hose in the bucket. In a first preferred embodiment the attachment unit is configured for standard faucets. In a second preferred embodiment the attachment unit is configured for contemporary faucets.

Accordingly, it is a principal object of the invention to provide an apparatus and method for transferring water from a faucet to a bucket, which reduces the risk of spills and resulting possible personal injury and/or property damage.

It is another object of the invention to provide an apparatus for transferring water from a standard faucet.

It is a further object of the invention to provide an apparatus for transferring water from a contemporary faucet.

Still another object of the invention is to provide an apparatus and method that may be used to transfer any liquid from a faucet to a suitable container.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an apparatus and method for fluid transfer, which designed for but not limited to filling buckets with water.

Figure 1:
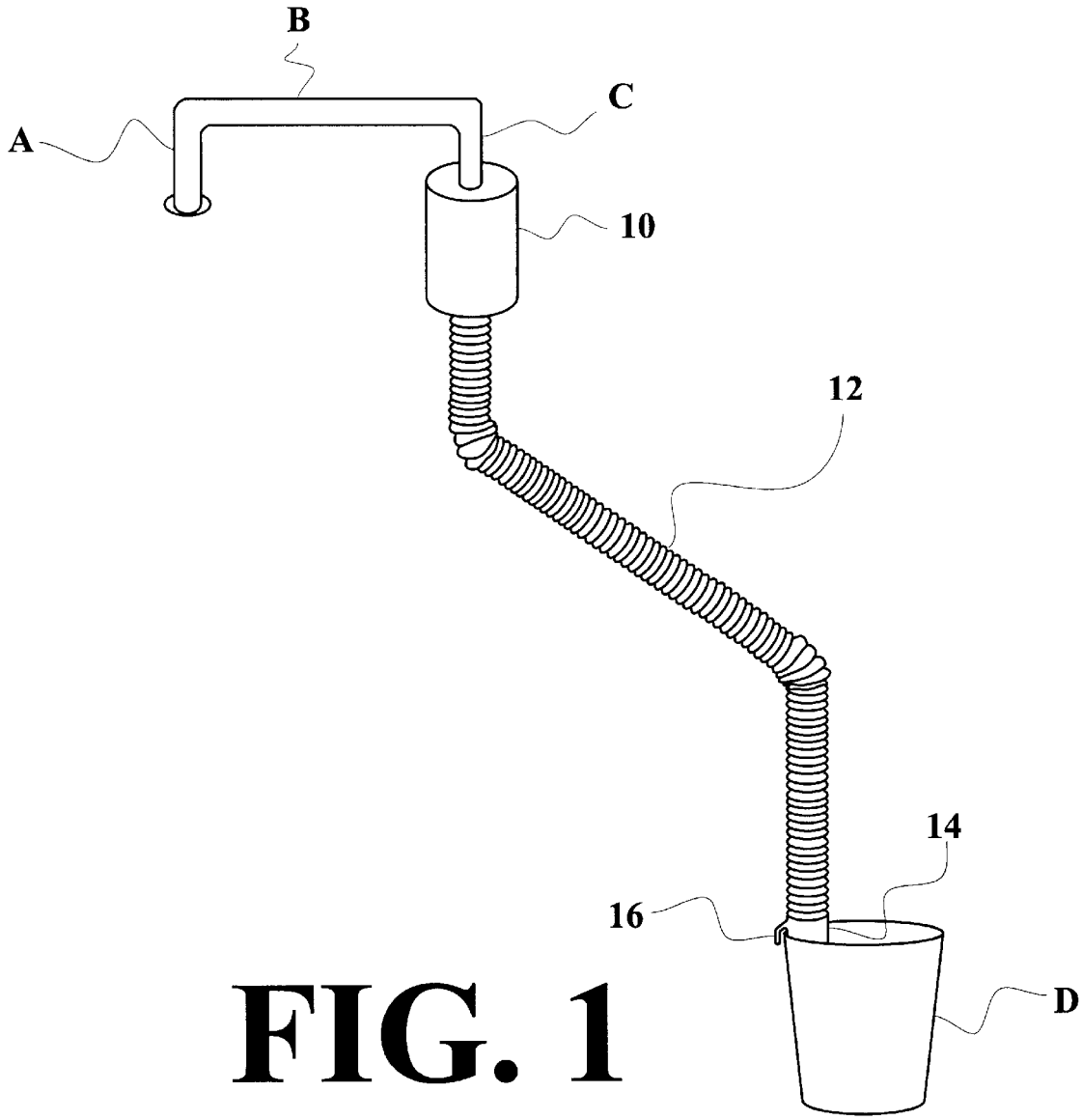
FIG. 1 is a perspective environmental view of the first preferred embodiment of the invention.

FIG. 1 is a perspective environmental view of the first preferred embodiment of the invention. Water flows from the standard faucet A, with a horizontal arm B and a spout C at a right angle from the arm, through the attachment unit or funnel 10, the hose 12, and out the tip 14, into the bucket D. The tip has a hook 16 to retain it on the side of the bucket.

Figure 2:
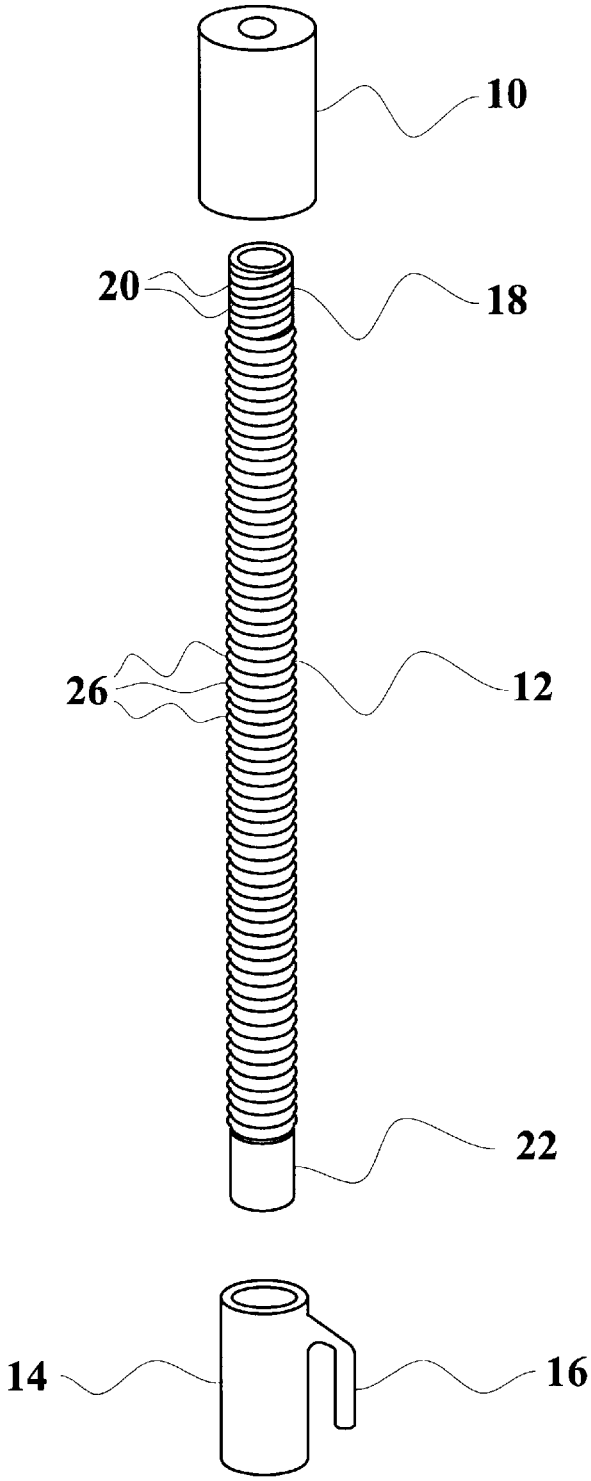
FIG. 2 is an exploded perspective view of the first preferred embodiment of the invention.

FIG. 2 is an exploded perspective view of the first preferred embodiment of the invention. At the upper end of the hose is a male coupling 18 with exterior threads 20 that engage interior threads in a female coupling in the lower portion of the attachment unit. At the lower end of the hose is a male coupling 22 that is inserted into a female coupling in the upper portion of the tip, and permanently attached by glue or other suitable means. Between the couplings, the hose is flexible and reinforced with helical ribbing 26.

Figure 3:
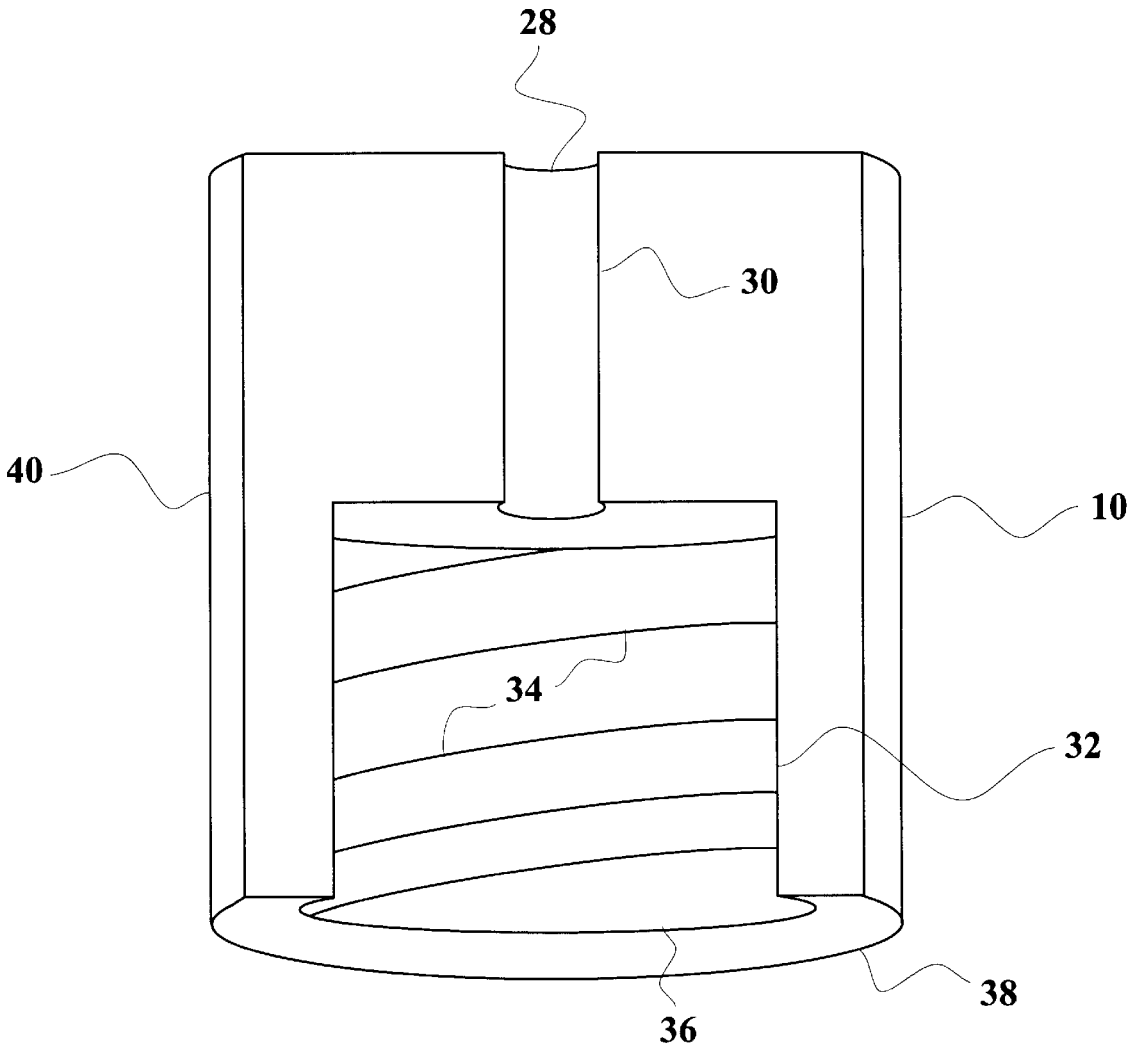
FIG. 3 is a cross sectional perspective view of the funnel for the first preferred embodiment of the invention.

FIG. 3 is a cross sectional perspective view of the attachment unit for the first preferred embodiment of the invention, showing an upper opening 28 for the standard faucet, a channel 30 for fluid, a female coupling 32 with interior threads 34, and a bottom opening 36. The attachment unit is made of a solid foam that is flexible and resilient, preferably plastic or rubber with a closed cellular structure. The attachment unit is generally cylindrical, with a flat circular top face (not shown in FIG. 3), a flat circular bottom face 38, and a curved side 40 between the top face and the bottom face. In the first preferred embodiment, the upper opening 28 is in the center of the top face, and the channel 30 is cylindrical and shares a common axis with the cylindrical shape of the attachment unit.

Figure 4:
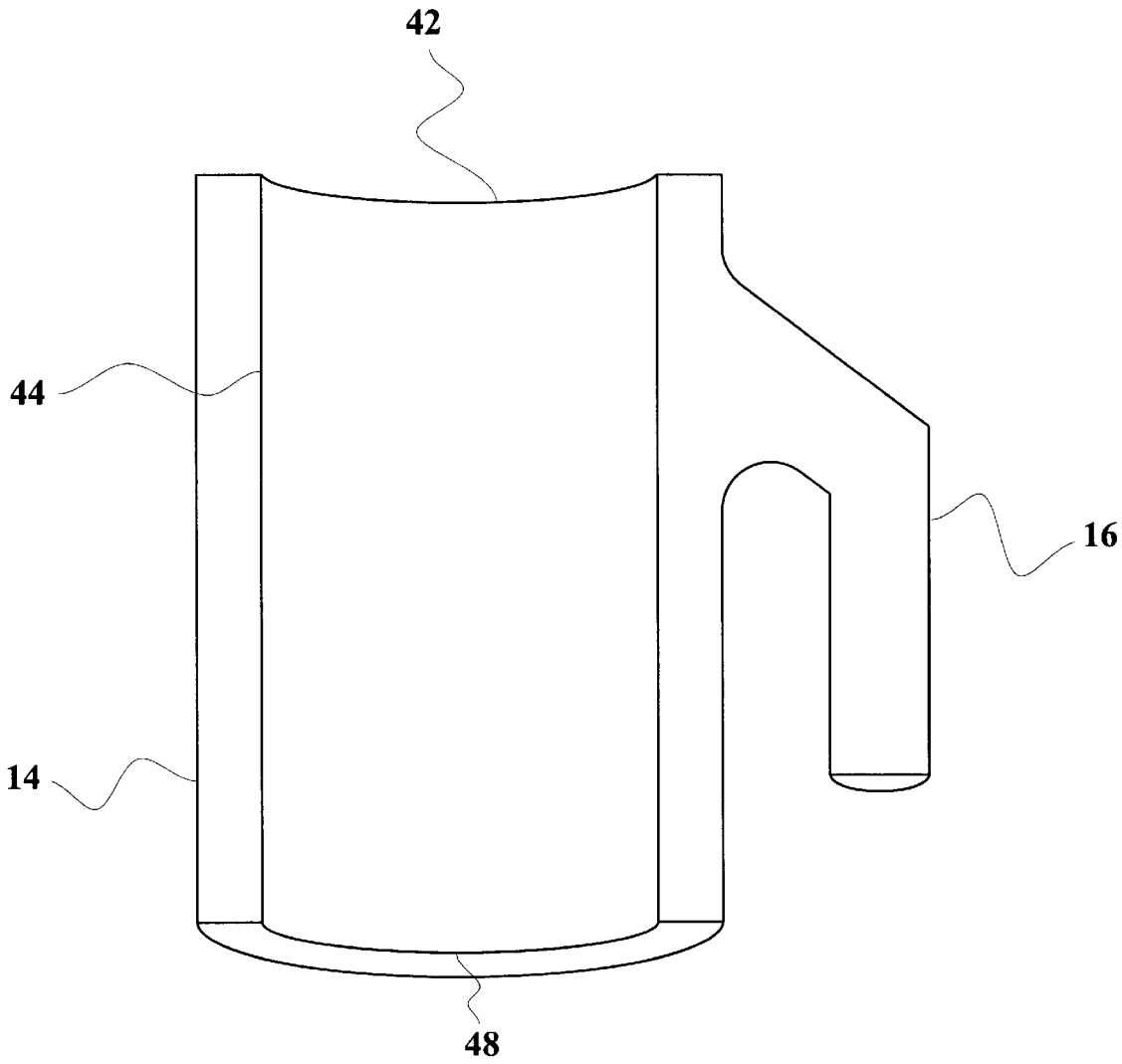
FIG. 4 is a cross sectional perspective view of the hose tip for the first and second preferred embodiments of the invention.

FIG. 4 is a cross sectional perspective view of the hose tip 14 with hook 16, which is the same for the first and second preferred embodiments of the invention. The hose tip has an upper opening 42, a female coupling 44, and a bottom opening 48. The hose tip is preferably made from hard plastic.

Figure 5:
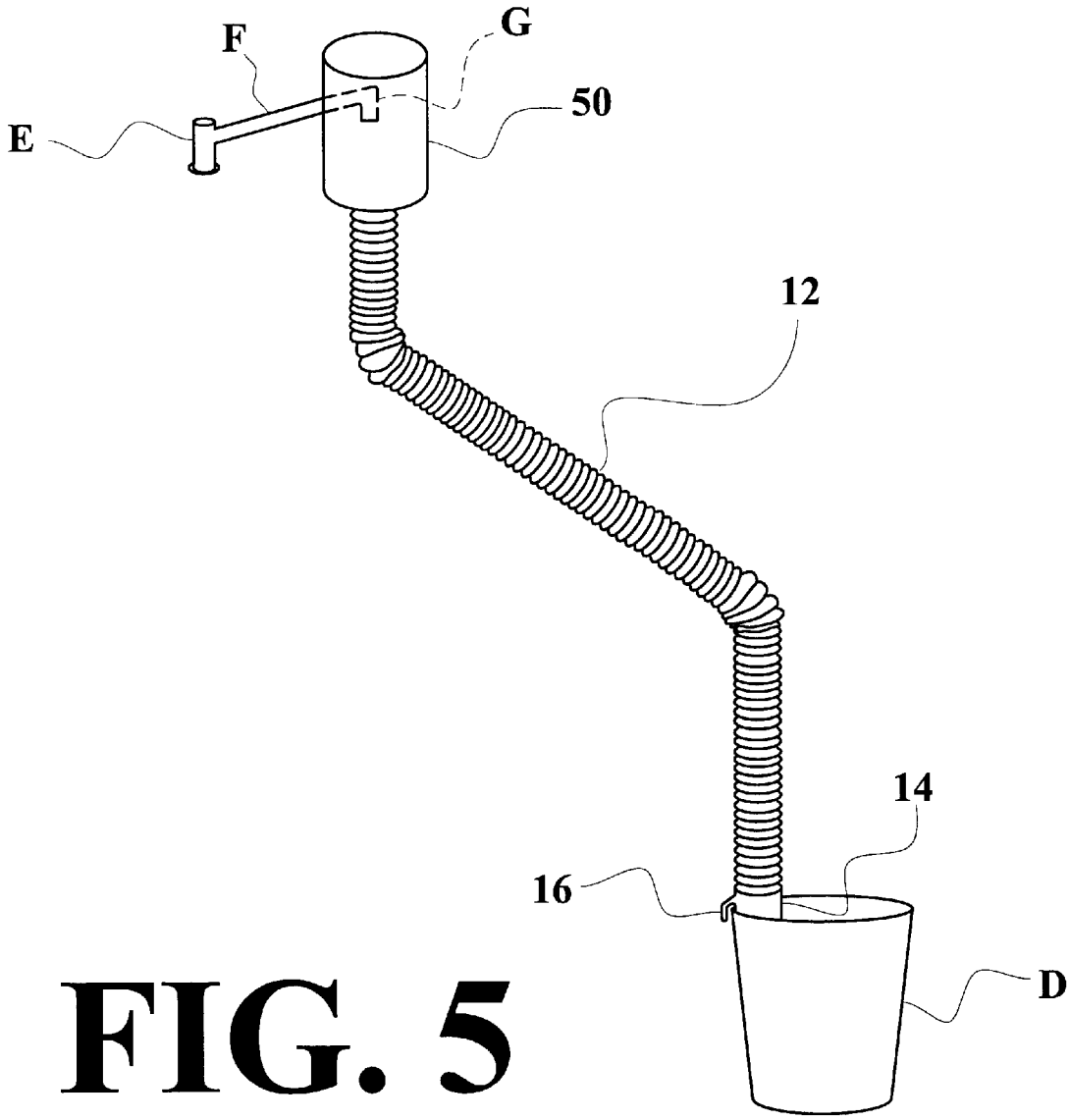
FIG. 5 is a perspective environmental view of the second preferred embodiment of the invention.

FIG. 5 is a perspective environmental view of the second preferred embodiment of the invention, which is the same as the first preferred embodiment, except for attachment unit 50, which is suitably dimensioned and configured to receive a contemporary faucet E, with an upward sloping arm F and a spout G that is at an acute angle from the arm.

Figure 6:
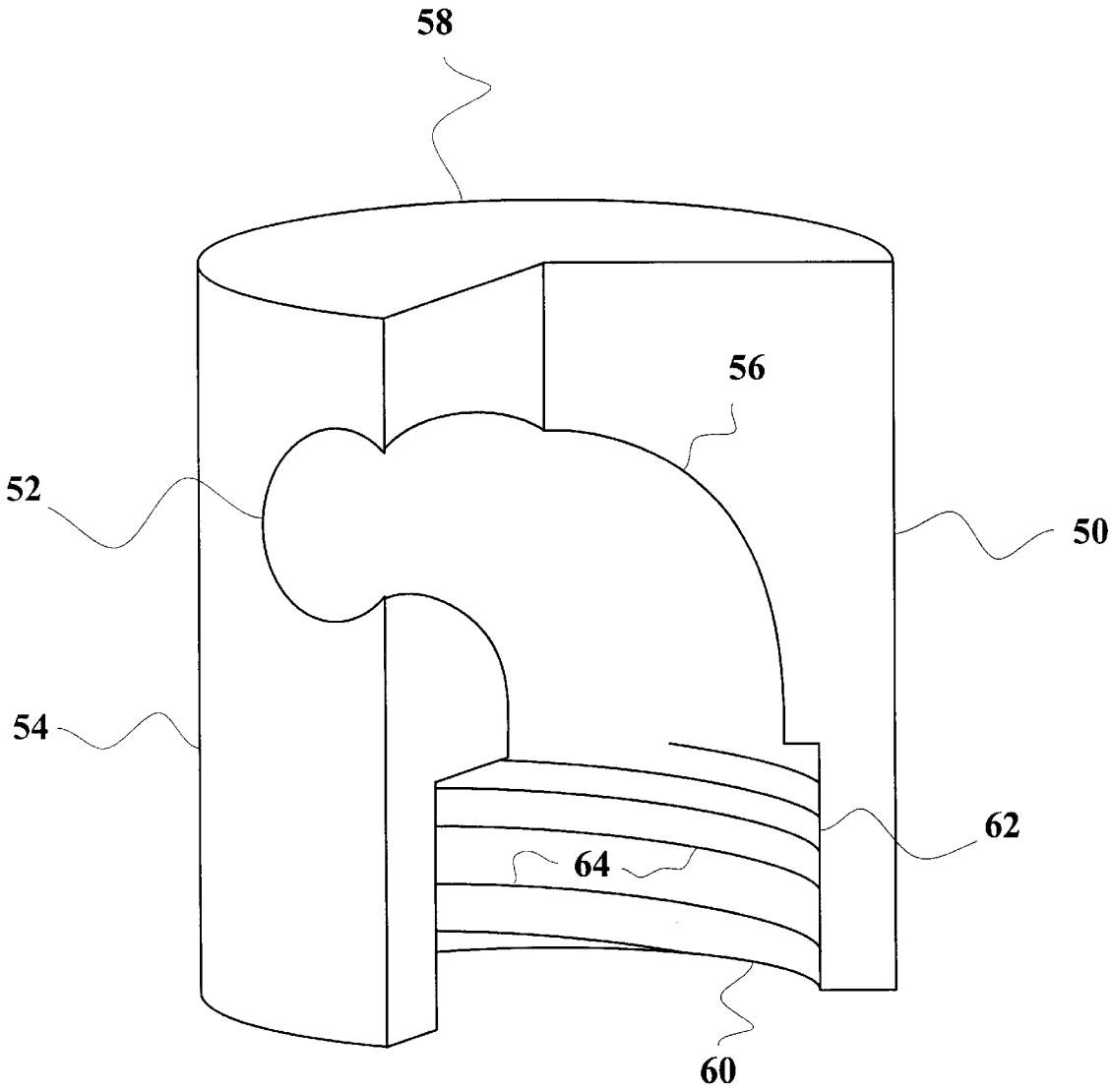
FIG. 6 is a cross sectional perspective view of the funnel for the second preferred embodiment of the invention.

FIG. 6 is a cross sectional perspective view of the attachment unit 50 for the second preferred embodiment of the invention, which is the same as the attachment unit for the first preferred embodiment of the invention, except that it has its upper opening 52 in its curved side 54, and has a curved channel 56. Also shown are the flat circular top face 58, the bottom opening 60, and the female coupling 62 with interior threads 64.

The invention also includes methods of using the apparatus, with the following steps:

1. Assembling the invention by screwing the attachment unit onto the end of the hose opposite the tip with the hook.
2. Placing the attachment unit over the spout of a faucet.
3. Placing the tip inside a bucket, pail or other container, with the hook passing over the side the container to retain the bottom end of the hose in the container.
4. Allowing fluid to pass from the faucet through the attachment unit and the hose into the container.

It is to be understood that the present invention is not limited to the embodiments described above, but encompasses any and all embodiments within the scope of the following claims.

We claim:

1. A fluid transfer apparatus, comprising:

a hose with a first opening and a second opening;

an attachment unit made of a solid foam material that is flexible and resilient, said attachment unit having a first opening suitably dimensioned and configured to expandably receive and retain a faucet, a second opening that can be connected to the first opening of the hose, and an interior channel for fluid between the first opening and the second opening;

wherein the attachment unit is generally cylindrical with a flat circular top face, a flat circular bottom face, and a curved side between the top face and the bottom face;

wherein the second opening of the attachment unit is in the bottom face;

wherein the first opening of the attachment unit is in the top face; and a tip at the second opening of the hose, and an immovable hook projecting from the tip, whereby the tip is adapted to be retained inside a fluid container, with the hook passing over a side of the container.

2. The fluid transfer apparatus according to claim 1, including:

a male coupling at the first opening of the hose, said male coupling having a threaded exterior surface that can engage a threaded interior surface in the second opening of the attachment unit.

3. The fluid transfer apparatus according to claim 2, wherein the hose is flexible except for the tips and the male coupling.

4. The fluid transfer apparatus according to claim 3, wherein between the tips at the first and second openings, the hose is reinforced by a helical ribbing.

5. The fluid transfer apparatus according to claim 4, wherein the attachment unit is made of a material selected from the group comprising plastic and rubber.

6. The fluid transfer apparatus according to claim 5, wherein the material that the attachment unit is made from has a closed cellular structure.

7. A fluid transfer apparatus, comprising:

a hose with a first opening and a second opening;

an attachment unit made of a solid foam material that is flexible and resilient, said attachment unit having a first opening suitably dimensioned and configured to expandably receive and retain a faucet, a second opening that can be connected to the first opening of the hose, and an interior channel for fluid between the first opening and the second opening;

wherein the attachment unit is generally cylindrical with a flat circular top face, a flat circular bottom face, and a curved side between the top face and the bottom face;

wherein the second opening of the attachment unit is in the bottom face;

wherein the first opening of the attachment unit is in the curved side; and a tip at the second opening of the hose, and an immovable hook projecting from the tip, whereby the tip is adapted to be retained inside a fluid container, with the hook passing over a side of the container.

8. The fluid transfer apparatus according to claim 7, including:

a male coupling at the first opening of the hose, said male coupling having a threaded exterior surface that can engage a threaded interior surface in the second opening of the attachment unit.

9. The fluid transfer apparatus according to claim 8, wherein the hose is flexible, except for the tips and the male coupling.

10. The fluid transfer apparatus according to claim 9, wherein between the tips at the first and second openings, the hose is reinforced by a helical ribbing.

11. The fluid transfer apparatus according to claim 10, wherein the attachment unit is made of a material selected from the group comprising plastic and rubber.

12. The fluid transfer apparatus according to claim 11, wherein the material that the attachment unit is made from has a closed cellular structure.

13. A fluid transfer method, comprising the steps of:

connecting a hose to an attachment unit made of a solid foam that is flexible and resilient, said attachment unit having a first opening and a second opening that is connected to a first opening of the hose, and said attachment unit also having an interior channel for fluid between its first opening and its second opening;

placing the first opening of the attachment unit over an opening of a faucet;

placing a second opening of the hose in a fluid container, the hose being retained inside of the fluid container by an immovable hook extending from a tip at the second opening of the hose, with the hook passing over a side of the container; and allowing fluid to pass from the faucet through the attachment unit and the hose into the fluid container.

14. The fluid transfer method according to claim 13, wherein the hose is connected to the attachment unit by screwing a tip having an exterior threaded surface at the first opening of the hose into an interior threaded surface of the second opening of the attachment unit.

* * * * *